US010244311B2

(12) United States Patent
Litovsky et al.

(10) Patent No.: US 10,244,311 B2
(45) **Date of Patent: *Mar. 26, 2019**

(54) ACOUSTIC DEVICE

(71) Applicant: Bose Corporation, Framingham, MA (US)

(72) Inventors: Roman N. Litovsky, Newton, MA (US); Chester S. Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,381

(22) Filed: Jul. 11, 2017

(65) Prior Publication Data

US 2017/0311074 A1 Oct. 26, 2017

Related U.S. Application Data

(63) Continuation of application No. 15/150,700, filed on May 10, 2016, now Pat. No. 9,736,574, which is a continuation-in-part of application No. 14/799,265, filed on Jul. 14, 2015, now Pat. No. 9,571,917.

(60) Provisional application No. 62/026,237, filed on Jul. 18, 2014.

(51) Int. Cl.
*H04R 1/28* (2006.01)
*H04R 5/033* (2006.01)

(52) U.S. Cl.
CPC ..... *H04R 1/2857* (2013.01); *H04R 5/0335* (2013.01); *H04R 1/288* (2013.01); *H04R 2201/023* (2013.01)

(58) Field of Classification Search
CPC ..... H04R 1/026; H04R 1/105; H04R 1/2838; H04R 1/2853; H04R 1/2857; H04R 1/288; H04R 5/0335; H04R 2201/023
See application file for complete search history.

(56) References Cited

U.S. PATENT DOCUMENTS

2003/0152239 A1* 8/2003 Graefenstein ..... G10K 11/178 381/71.5

FOREIGN PATENT DOCUMENTS

GB 2517486 * 2/2015

* cited by examiner

*Primary Examiner* — Tuan D Nguyen
(74) *Attorney, Agent, or Firm* — Brian M. Dingman; Dingman IP Law, PC

(57) ABSTRACT

An acoustic device that has a neck loop that is constructed and arranged to be worn around the neck. The neck loop includes a housing with a first acoustic waveguide having a first sound outlet opening, and a second acoustic waveguide having a second sound outlet opening. There is a first open-backed acoustic driver acoustically coupled to the first waveguide and a second open-backed acoustic driver acoustically coupled to the second waveguide.

27 Claims, 14 Drawing Sheets

ACOUSTIC DEVICE

CROSS-REFERENCE TO RELATED APPLICATIONS

This application is a continuation of application Ser. No. 15/150,700, filed on May 10, 2016 (pending), which is a continuation in part of application Ser. No. 14/799,265, filed on Jul. 14, 2015 (now U.S. Pat. No. 9,571,917, issued on Feb. 14, 2017), which itself claimed benefit from U.S. Provisional Patent Application No. 62/026,237, filed on Jul. 18, 2014, the entire contents of which are incorporated herein by reference.

BACKGROUND

This disclosure relates to an acoustic device.

Headsets have acoustic drivers that sit on, over or in the ear. They are thus somewhat obtrusive to wear, and can inhibit the user's ability to hear ambient sounds.

SUMMARY

All examples and features mentioned below can be combined in any technically possible way.

The present acoustic device directs high quality sound to each ear without acoustic drivers on, over or in the ears. The acoustic device is designed to be worn around the neck. The acoustic device may comprise a neck loop with a housing. The neck loop may have a "horseshoe"-like, or generally "U" shape, with two legs that sit over or near the clavicles and a curved central portion that sits behind the neck. The acoustic device may have two acoustic drivers; one on each leg of the housing. The drivers may be located below the expected locations of the ears of the user, with their acoustic axes pointed at the ears. The acoustic device may further include two waveguides within the housing, each one having an exit below an ear, close to a driver. The rear side of one driver may be acoustically coupled to the entrance to one waveguide and the rear side of the other driver may be acoustically coupled to the entrance to the other waveguide. Each waveguide may have one end with the driver that feeds it located below one ear (left or right), and the other end (the open end) located below the other ear (right or left), respectively.

The waveguides may fold over one another within the housing. The waveguides may be constructed and arranged such that the entrance and exit to each one is located at the top side of the housing. The waveguides may be constructed and arranged such that each one has a generally consistent cross-sectional area along its length. The waveguides may be constructed and arranged such that each one begins just behind one driver, runs down along the top portion of the housing in the adjacent leg of the neck loop to the end of the leg, turns down to the bottom portion of the housing and turns 180 degrees to run back up the leg, then across the central portion and back down the top portion of the other leg, to an exit located just posteriorly of the other driver. Each waveguide may flip position from the bottom to the top portion of the housing in the central portion of the neck loop.

In one aspect, an acoustic device includes a neck loop that is constructed and arranged to be worn around the neck. The neck loop includes a housing with comprises a first acoustic waveguide having a first sound outlet opening, and a second acoustic waveguide having a second sound outlet opening. There is a first open-backed acoustic driver acoustically coupled to the first waveguide and a second open-backed acoustic driver acoustically coupled to the second waveguide.

Embodiments may include one of the following features, or any combination thereof. The first and second acoustic drivers may be driven such that they radiate sound that is out of phase, over at least some of the spectrum. The first open-backed acoustic driver may be carried by the housing and have a first sound axis that is pointed generally at the expected location of one ear of the user, and the second open-backed acoustic driver may also be carried by the housing and have a second sound axis that is pointed generally at the expected location of the other ear of the user. The first sound outlet opening may be located proximate to the second acoustic driver and the second sound outlet opening may be located proximate to the first acoustic driver. Each waveguide may have one end with its corresponding acoustic driver located at one side of the head and in proximity to and below the adjacent ear, and another end that leads to its sound outlet opening, located at the other side of the head and in proximity to and below the other, adjacent ear.

Embodiments may include one of the above or the following features, or any combination thereof. The housing may have an exterior wall, and the first and second sound outlet openings may be defined in the exterior wall of the housing. The waveguides may both be defined by the exterior wall of the housing and an interior wall of the housing. The interior wall of the housing may lie along a longitudinal axis that is twisted 180° along its length. The neck loop may be generally "U"-shaped with a central portion and first and second leg portions that depend from the central portion and that have distal ends that are spaced apart to define an open end of the neck loop, wherein the twist in the housing interior wall is located in the central portion of the neck loop. The interior wall of the housing may be generally flat and lie under both sound outlet openings. The interior wall of the housing may comprise a raised sound diverter underneath each of the sound outlet openings. The housing may have a top that faces the ears when worn by the user, and wherein the first and sound outlet openings are defined in the top of the housing.

Embodiments may include one of the above or the following features, or any combination thereof. The housing may have a top portion that is closest to the ears when worn by the user and a bottom portion that is closest to the torso when worn by the user, and each waveguide may lie in part in the top portion of the housing and in part in the bottom portion of the housing. The neck loop may be generally "U"-shaped with a central portion and first and second leg portions that depend from the central portion and that have distal ends that are spaced apart to define an open end of the neck loop. The twist in the housing interior wall may be located in the central portion of the neck loop. The first acoustic driver may be located in the first leg portion of the neck loop and the second acoustic driver may be located in the second leg portion of the neck loop. The first waveguide may begin underneath the first acoustic driver, extend along the top portion of the housing to the distal end of the first leg portion of the neck loop and turn to the bottom portion of the housing and extend along the first leg portion into the central portion of the neck loop where it turns to the top portion of the housing and extends into the second leg portion to the first sound outlet opening. The second waveguide may begin underneath the second acoustic driver, extend along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

In another aspect an acoustic device includes a neck loop that is constructed and arranged to be worn around the neck, the neck loop comprising a housing that comprises a first acoustic waveguide having a first sound outlet opening, and a second acoustic waveguide having a second sound outlet opening, a first open-backed acoustic driver acoustically coupled to the first waveguide, where the first open-backed acoustic driver is carried by the housing and has a first sound axis that is pointed generally at the expected location of one ear of the user, a second open-backed acoustic driver acoustically coupled to the second waveguide, where the second open-backed acoustic driver is carried by the housing and has a second sound axis that is pointed generally at the expected location of the other ear of the user, wherein the first sound outlet opening is located proximate to the second acoustic driver and the second sound outlet opening is located proximate to the first acoustic driver, and wherein the first and second acoustic drivers are driven such that they radiate sound that is out of phase.

Embodiments may include one of the following features, or any combination thereof. The waveguides may both be defined by the exterior wall of the housing and an interior wall of the housing, and wherein the interior wall of the housing lies along a longitudinal axis that is twisted 180° along its length. The neck loop may be generally "U"-shaped with a central portion and first and second leg portions that depend from the central portion and that have distal ends that are spaced apart to define an open end of the neck loop, wherein the twist in the housing interior wall is located in the central portion of the neck loop. The housing may have a top portion that is closest to the ears when worn by the user and a bottom portion that is closest to the torso when worn by the user, and wherein each waveguide lies in part in the top portion of the housing and in part in the bottom portion of the housing.

In another aspect an acoustic device includes a neck loop that is constructed and arranged to be worn around the neck, the neck loop comprising a housing that comprises a first acoustic waveguide having a first sound outlet opening, and a second acoustic waveguide having a second sound outlet opening, wherein the waveguides are both defined by the exterior wall of the housing and an interior wall of the housing, and wherein the interior wall of the housing lies along a longitudinal axis that is twisted 180° along its length, wherein the neck loop is generally "U"-shaped with a central portion and first and second leg portions that depend from the central portion and that have distal ends that are spaced apart to define an open end of the neck loop, wherein the twist in the housing interior wall is located in the central portion of the neck loop, wherein the housing has a top portion that is closest to the ears when worn by the user and a bottom portion that is closest to the torso when worn by the user, and wherein each waveguide lies in part in the top portion of the housing and in part in the bottom portion of the housing. There is a first open-backed acoustic driver acoustically coupled to the first waveguide, where the first open-backed acoustic driver is located in the first leg portion of the neck loop and has a first sound axis that is pointed generally at the expected location of one ear of the user. There is a second open-backed acoustic driver acoustically coupled to the second waveguide, where the second open-backed acoustic driver is located in the second leg portion of the neck loop and has a second sound axis that is pointed generally at the expected location of the other ear of the user. The first and second acoustic drivers are driven such that they radiate sound that is out of phase. The first sound outlet opening is located proximate to the second acoustic driver and the second sound outlet opening is located proximate to the first acoustic driver. The first waveguide begins underneath the first acoustic driver, extends along the top portion of the housing to the distal end of the first leg portion of the neck loop where it turns to the bottom portion of the housing and extends along the first leg portion into the central portion of the neck loop where it turns to the top portion of the housing and extends into the second leg portion to the first sound outlet opening, and the second waveguide begins underneath the second acoustic driver, extends along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

In another aspect an acoustic device includes a neck loop that is constructed and arranged to be worn around the neck, the neck loop comprising a first acoustic waveguide having a first sound outlet opening, and a second acoustic waveguide having a second sound outlet opening, a first open-backed acoustic driver acoustically coupled to the first waveguide, and a second open-backed acoustic driver acoustically coupled to the second waveguide. There is a first pressure damping element acoustically coupled to the first waveguide, where the first pressure damping element is constructed and arranged to damp one or more acoustic resonances in the first waveguide, and a second pressure damping element acoustically coupled to the second waveguide, where the second pressure damping element is constructed and arranged to damp one or more acoustic resonances in the second waveguide.

Embodiments may include one of the following features, or any combination thereof. The first pressure damping element may be acoustically coupled to the first waveguide at a first location of a pressure maximum for a first wavelength to be damped, and the second pressure damping element may be acoustically coupled to the second waveguide at a second location of a pressure maximum for a second wavelength to be damped. The first location may be at a distance from the first sound outlet opening of about one-quarter of the first wavelength, and the second location may be at a distance from the second sound outlet opening of about one-quarter of the second wavelength. The first and second pressure damping elements may comprise at least one of: foam with at least some closed cells; a waveguide wall opening with a resistive structure covering or in the wall opening; and a pressure-loss stub.

Embodiments may include one of the following features, or any combination thereof. At least one of the first and second pressure damping elements may comprise a shunt waveguide. The shunt waveguide may comprise a tube open at both ends, with one end located inside of or directly coupled to the first or second waveguide and with a resistive structure located at or proximate the other end. The other end of the tube may be located in the first or second waveguide, in about the same plane as the sound outlet opening of the waveguide. The tube may have a length equal to about one-quarter of the wavelength of an acoustic resonance to be damped.

Embodiments may include one of the following features, or any combination thereof. The first and second acoustic drivers may be driven such that they radiate sound that is out of phase. The first acoustic driver may be carried by the neck loop and have a first sound axis that is pointed generally at the expected location of one ear of the user, and the second acoustic driver may be carried by the neck loop and have a second sound axis that is pointed generally at the expected location of the other ear of the user. The first sound outlet opening may be located proximate to the second acoustic driver and the second sound outlet opening may be located proximate to the first acoustic driver. Each waveguide may have one end with its corresponding acoustic driver located at one side of the head and in proximity to and below the adjacent ear, and another end that leads to its sound outlet opening, located at the other side of the head and in proximity to and below the other, adjacent ear.

Embodiments may include one of the following features, or any combination thereof. The neck loop may have an exterior wall, and the first sound outlet opening may be defined in the exterior wall of the neck loop, and the second sound outlet opening may be defined in the exterior wall of the neck loop. The neck loop may have a top that faces the ears when worn by the user, and the first sound outlet opening may be defined in the top of the neck loop and the second sound outlet opening may be defined in the top of the neck loop. The waveguides may both be defined by the exterior wall of the neck loop and an interior wall of the neck loop.

Embodiments may include one of the following features, or any combination thereof. The neck loop may be generally "U"-shaped with a central portion and first and second leg portions that depend from the central portion and that have distal ends that are spaced apart to define an open end of the neck loop. The first acoustic driver may be located in the first leg portion of the neck loop and the second acoustic driver may be located in the second leg portion of the neck loop. The first sound outlet opening may be located in the second leg portion, and the second sound outlet opening may be located in the first leg portion. The acoustic device may further include a low resistance screen located in a waveguide between the back of the transducer and the sound outlet opening. The screen may be located directly behind the transducer. The neck loop may further comprise an acoustic volume between a waveguide and the back of the transducer, and a pressure damping element may be acoustically coupled to this acoustic volume.

In yet another aspect an acoustic device includes a neck loop that is constructed and arranged to be worn around the neck, the neck loop comprising a first acoustic waveguide having a first sound outlet opening, and a second acoustic waveguide having a second sound outlet opening, wherein the first and second waveguides are side-by-side in at least some of the neck loop. There is a first open-backed acoustic driver acoustically coupled to the first waveguide, and a second open-backed acoustic driver acoustically coupled to the second waveguide. Each waveguide has a first end and its corresponding acoustic driver located at one side of the head and below the adjacent ear, and each waveguide has a second end that leads to its sound outlet opening, located at the other side of the head and below the other, adjacent ear. There is a first pressure damping element acoustically coupled to the first waveguide, where the first pressure damping element is constructed and arranged to damp one or more acoustic resonances in the first waveguide, and a second pressure damping element acoustically coupled to the second waveguide, where the second pressure damping element is constructed and arranged to damp one or more acoustic resonances in the second waveguide.

Embodiments may include one of the following features, or any combination thereof. The waveguides may both be at least in part defined by the exterior wall of the neck loop and an interior wall of the neck loop. The first and second pressure damping elements may each comprise at least one of: foam with at least some closed cells; a waveguide wall opening with a resistive structure covering or in the wall opening; and a shunt waveguide.

DETAILED DESCRIPTION

Figure 1:
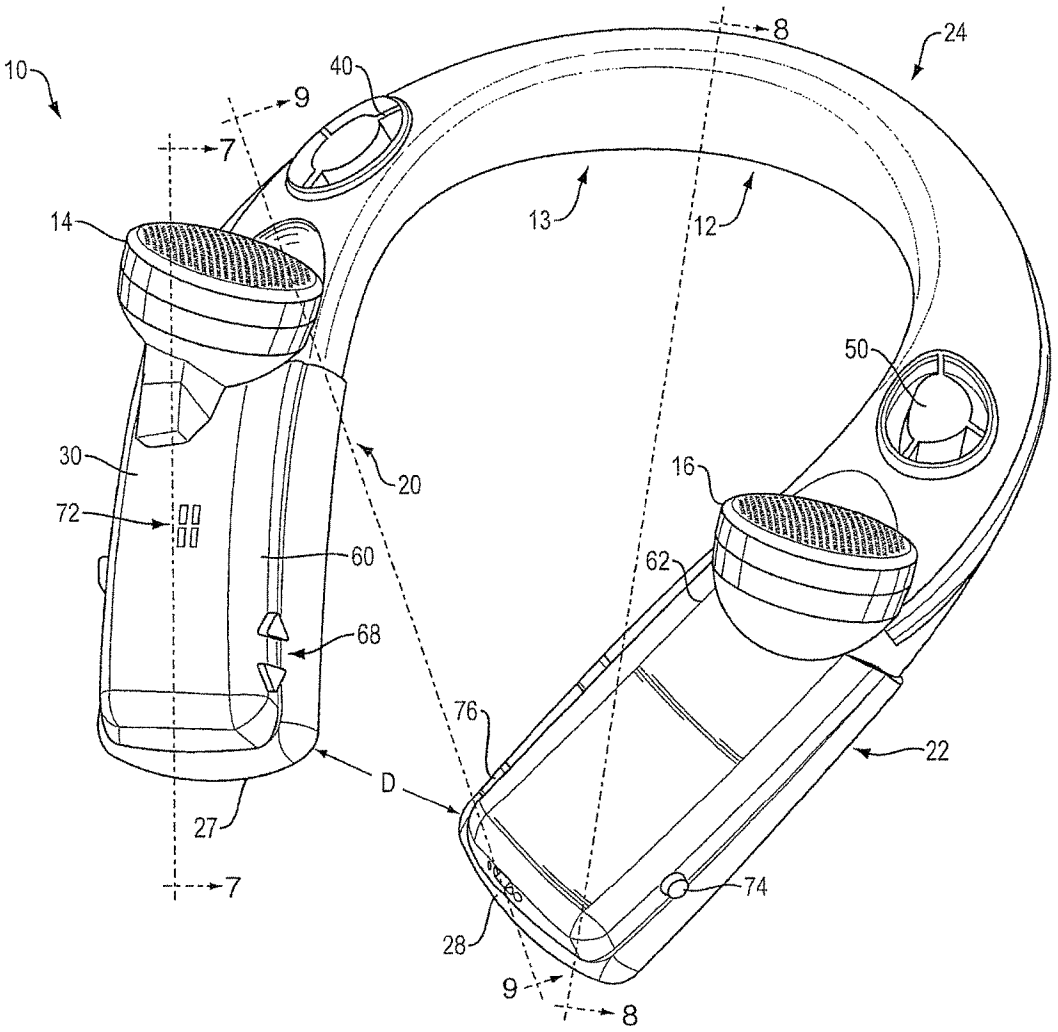
FIG. 1 is top perspective view of an acoustic device.

The acoustic device directs high quality sound to the ears without direct contact with the ears, and without blocking ambient sounds. The acoustic device is unobtrusive, and can be worn under (if the clothing is sufficiently acoustically transparent) or on top of clothing.

In one aspect, the acoustic device is constructed and arranged to be worn around the neck. The acoustic device has a neck loop that includes a housing. The neck loop has a horseshoe-like shape, with two legs that sit over the top of the torso on either side of the neck, and a curved central portion that sits behind the neck. The device has two acoustic drivers one on each leg of the housing. The drivers are located below the expected locations of the ears of the user, with their acoustic axes pointed at the ears. The acoustic device also has two waveguides within the housing, each one having an exit below an ear, close to a driver. The rear side of one driver is acoustically coupled to the entrance to one waveguide and the rear side of the other driver is acoustically coupled to the entrance to the other waveguide. Each waveguide has one end with the driver that feeds it located below one ear (left or right), and the other end (the open end) located below the other ear (right or left), respectively.

A non-limiting example of the acoustic device is shown in the drawings. This is but one of many possible examples that would illustrate the subject acoustic device. The scope of the invention is not limited by the example but rather is supported by the example.

Figure 2:
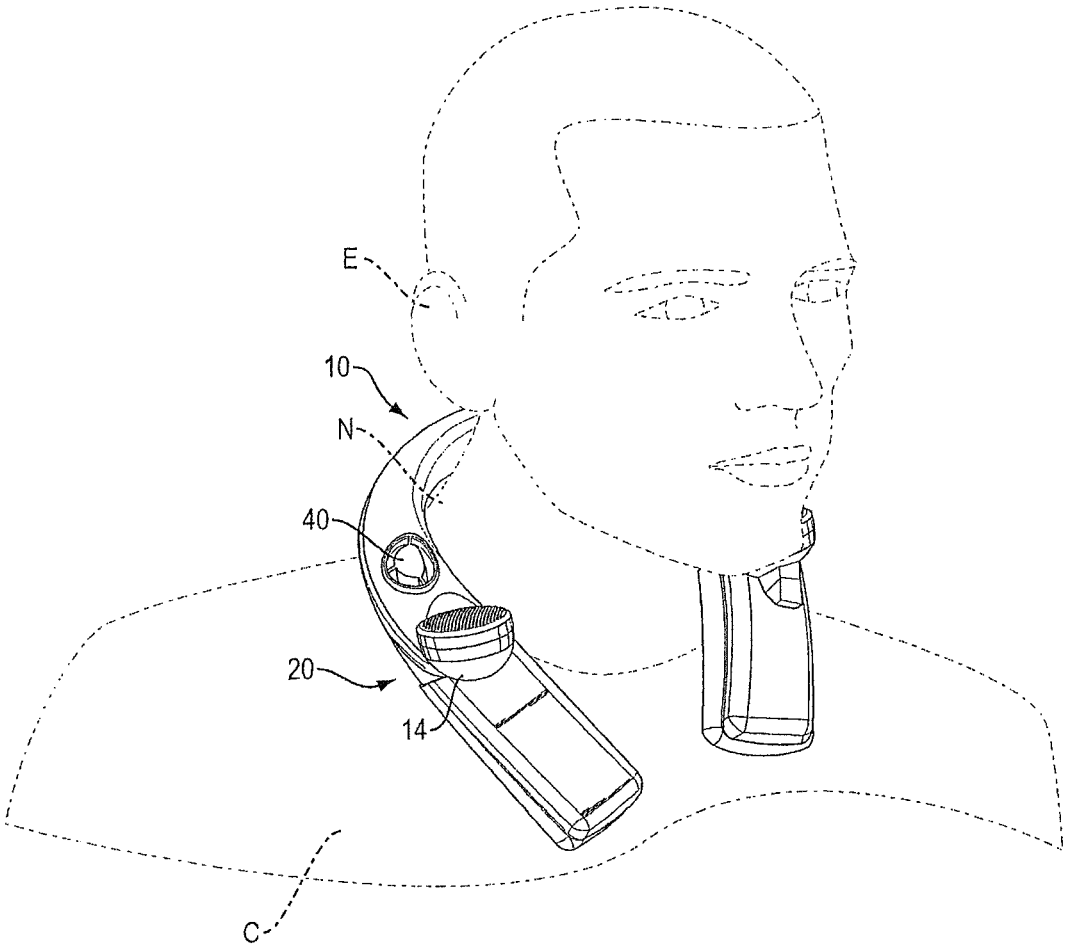
FIG. 2 is top perspective view of the acoustic device being worn by a user.
Figure 3:
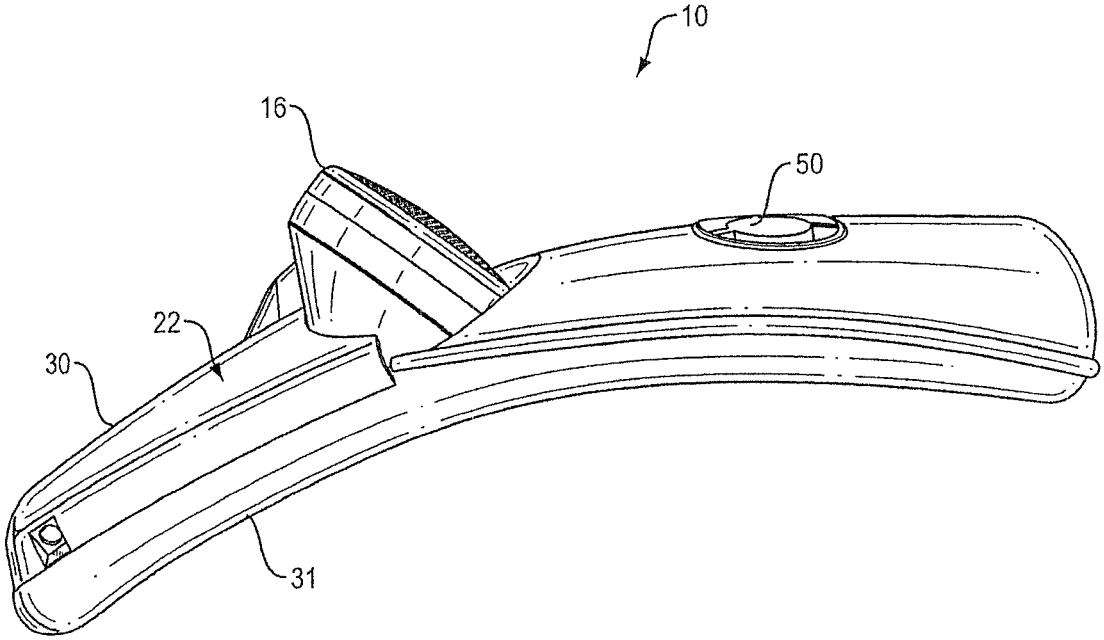
FIG. 3 is a right side view of the acoustic device.
Figure 4:
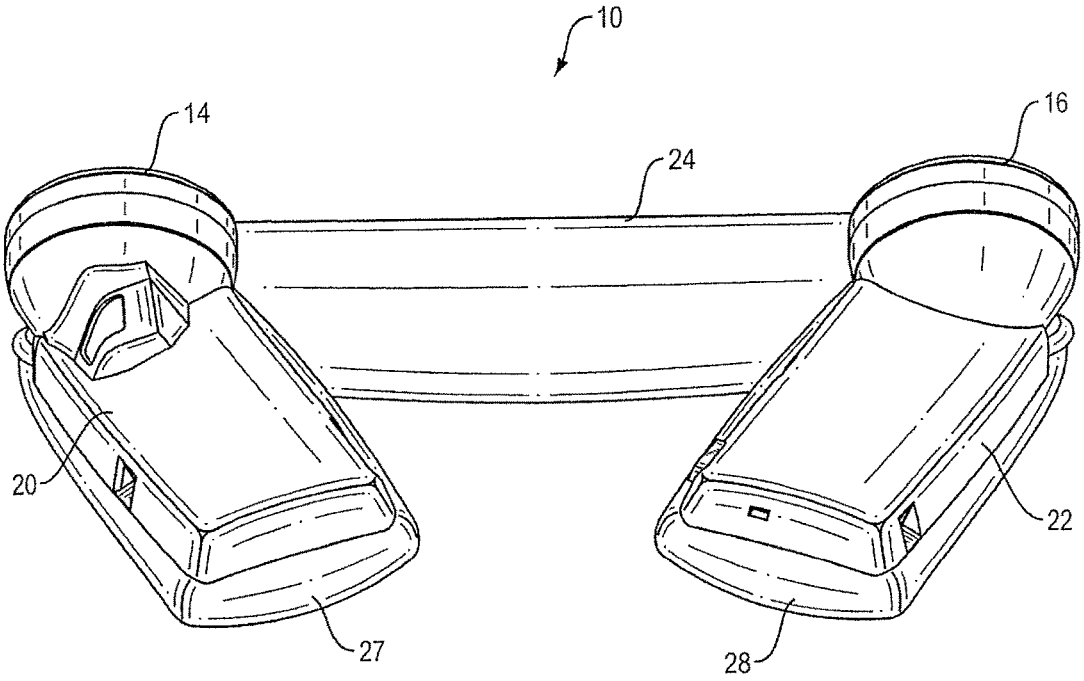
FIG. 4 is front view of the acoustic device.
Figure 5:
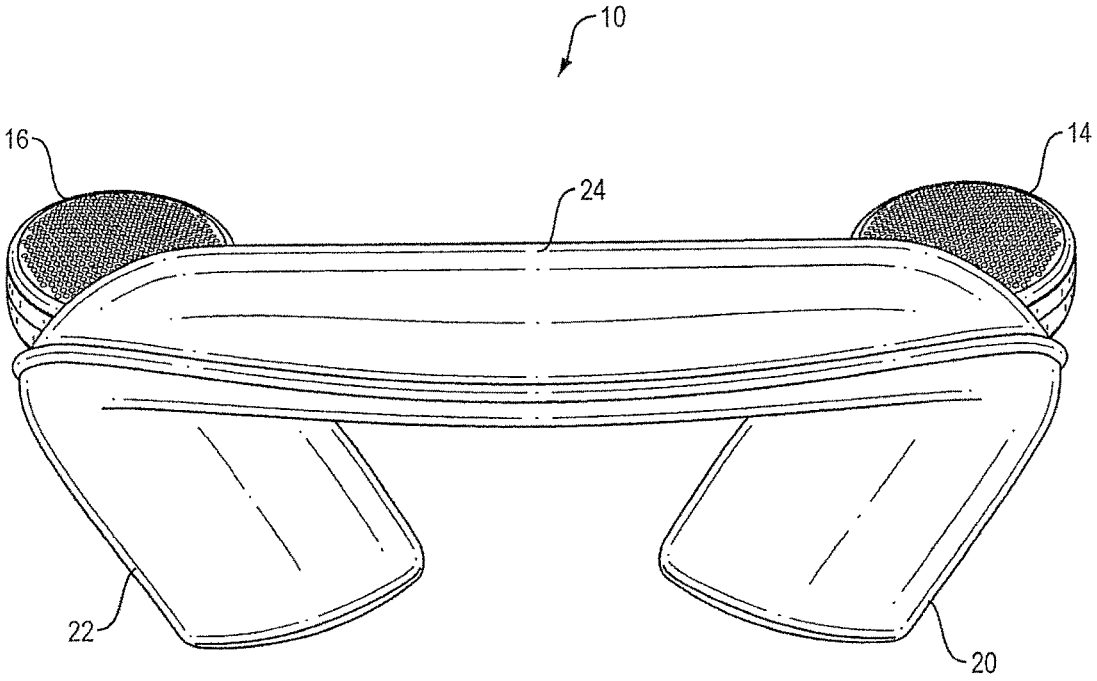
FIG. 5 is a rear view of the acoustic device.
Figure 6:
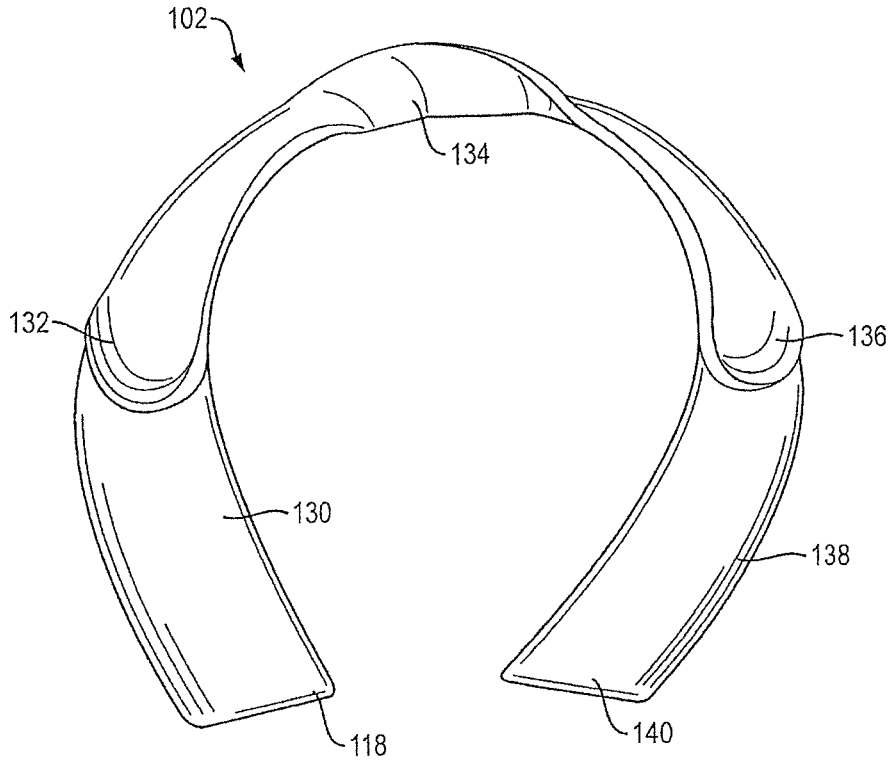
FIG. 6 is top perspective view of the interior septum or wall of the housing of the acoustic device.

Acoustic device 10 (FIGS. 1-9) includes a horseshoe-shaped (or, perhaps, generally "U"-shaped) neck loop 12 that is shaped, constructed and arranged such that it can be worn around the neck of a person, for example as shown in FIG. 2. Neck loop 12 has a curved central portion 24 that will sit at the nape of the neck "N", and right and left legs 20 and 22, respectively, that depend from central portion 24 and are constructed and arranged to drape over the upper torso on either side of the neck, generally over or near the clavicle "C." FIGS. 3-5 illustrate the overall form that helps acoustic device 10 to drape over and sit comfortably on the neck and upper chest areas.

Neck loop 12 comprises housing 13 that is in essence an elongated (solid or flexible) mostly hollow solid plastic tube (except for the sound inlet and outlet openings), with closed distal ends 27 and 28. Housing 13 is divided internally by integral wall (septum) 102. Two internal waveguides are defined by the external walls of the housing and the septum. Housing 13 should be stiff enough such that the sound is not substantially degraded as it travels through the waveguides. In the present non-limiting example, where the lateral distance "D" between the ends 27 and 28 of right and left neck loop legs 20 and 22 is less than the width of a typical human neck, the neck loop also needs to be sufficiently flexible such that ends 27 and 28 can be spread apart when device 10 is donned and doffed, yet will return to its resting shape shown in the drawings. One of many possible materials that has suitable physical properties is polyurethane. Other materials could be used. Also, the device could be constructed in other manners. For example, the device housing could be made of multiple separate portions that were coupled together, for example using fasteners and/or adhesives. And, the neck loop legs do not need to be arranged such that they need to be spread apart when the device is placed behind the neck with the legs draped over the upper chest.

Housing 13 carries right and left acoustic drivers 14 and 16. The drivers are located at the top surface 30 of housing 13, and below the expected location of the ears "E." See FIG. 2. Housing 13 has lower surface 31. The drivers may be canted or angled backwards (posteriorly) as shown, as may be needed to orient the acoustic axes of the drivers (not shown in the drawings) generally at the expected locations of the ears of the wearer/user. The drivers may have their acoustic axes pointed at the expected locations of the ears. Each driver may be about 10 cm from the expected location of the nearest ear, and about 26 cm from the expected location of the other ear (this distance measured with a flexible tape running under the chin up to the most distant ear). The lateral distance between the drivers is about 15.5 cm. This arrangement results in a sound pressure level (SPL) from a driver about three times greater at the closer ear than the other ear, which helps to maintain channel separation.

Located close to and just posteriorly of the drivers and in the top exterior wall 30 of housing 13 are waveguide outlets 40 and 50. Outlet 50 is the outlet for waveguide 110 which has its entrance at the back of right-side driver 14. Outlet 40 is the outlet for waveguide 160 which has its entrance at the back of left-side driver 16. See FIGS. 7-9. Accordingly, each ear directly receives output from the front of one driver and output from the back of the other driver. If the drivers are driven out of phase, the two acoustic signals received by each ear are virtually in phase below the fundamental waveguide quarter wave resonance frequency, that in the present non-limiting example is about 130-360 Hz. This ensures that low frequency radiation from each driver and the same side corresponding waveguide outlet, are in phase and do not cancel each other. At the same time the radiation from opposite side drivers and corresponding waveguides are out of phase, thus providing far field cancellation. This reduces sound spillage from the acoustic device to others who are nearby.

Acoustic device 10 includes right and left button socks or partial housing covers 60 and 62; button socks are sleeves that can define or support aspects of the device's user interface, such as volume buttons 68, power button 74, control button 76, and openings 72 that expose the microphone. When present, the microphone allows the device to be used to conduct phone calls (like a headset). Other buttons, sliders and similar controls can be included as desired. The user interface may be configured and positioned to permit ease of operation by the user. Individual buttons may be uniquely shaped and positioned to permit identification without viewing the buttons. Electronics covers are located below the button socks. Printed circuit boards that carry the hardware that is necessary for the functionality of acoustic device 10, and a battery, are located below the covers.

Housing 13 includes two waveguides, 110 and 160. See FIGS. 7-9. Sound enters each waveguide just behind/underneath a driver, runs down the top side of the neck loop leg on which the driver is located to the end of the leg, turns 180° and down to the bottom side of the housing at the end of the leg, and then runs back up the leg along the bottom side of the housing. The waveguide continues along the bottom side of the first part of the central portion of the neck loop. The waveguide then twists such that at or close to the end of the central portion of the neck loop it is back in the top side of the housing. The waveguide ends at an outlet opening located in the top of the other leg of the neck loop, close to the other driver. The waveguides are formed by the space between the outer wall of the housing and internal integral septum or wall 102. Septum 102 (shown in FIG. 6 apart from the housing) is generally a flat integral internal housing wall that has right leg 130, left leg 138, right end 118, left end 140, and central 180° twist 134. Septum 102 also has curved angled diverters 132 and 136 that direct sound from a waveguide that is running about parallel to the housing axis, up through an outlet opening that is in the top wall of the housing above the diverter, such that the sound is directed generally toward one ear.

Figure 7:
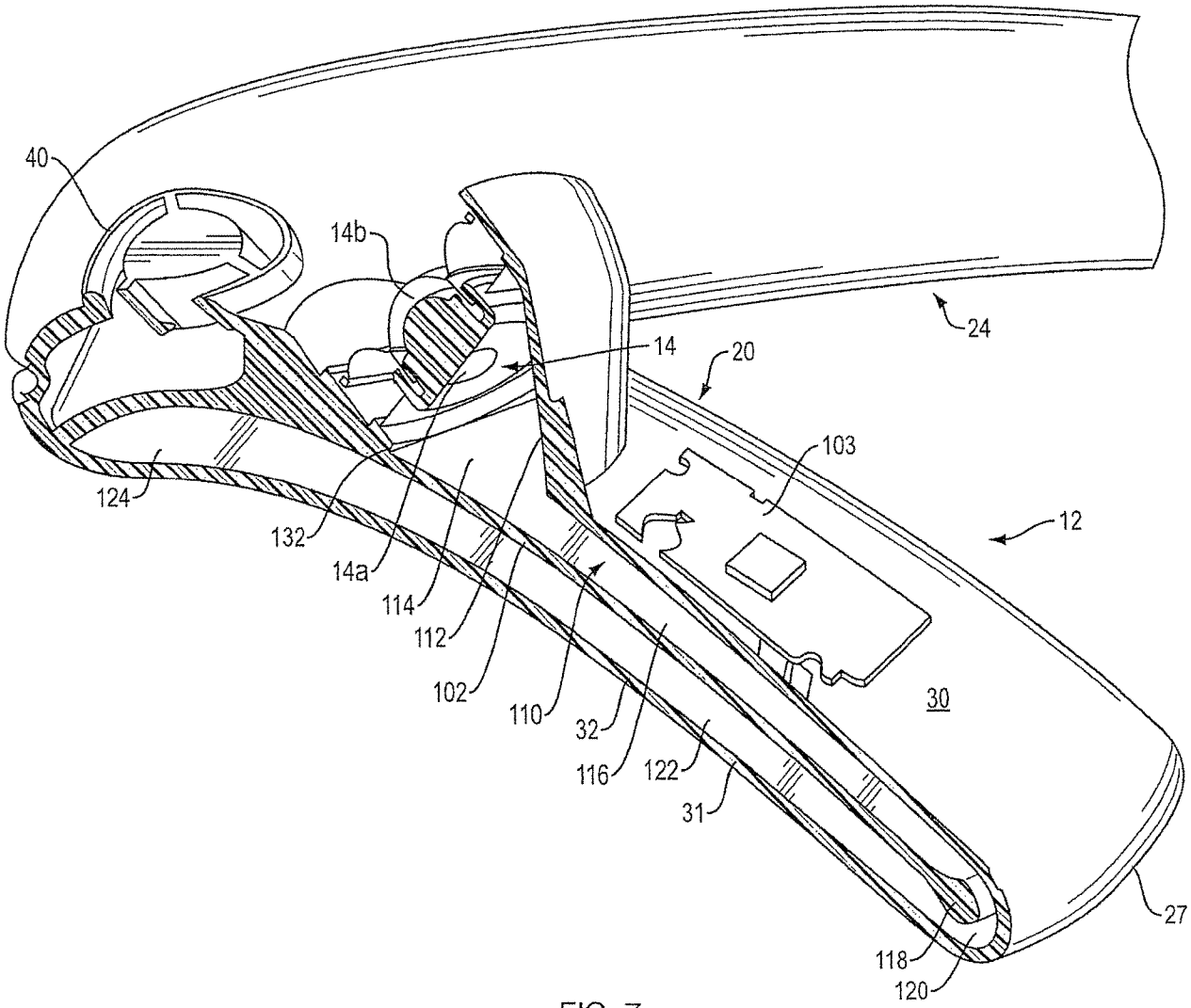
FIG. 7 is a first cross-sectional view of the acoustic device taken along line 7-7 in FIG. 1.
Figure 8:
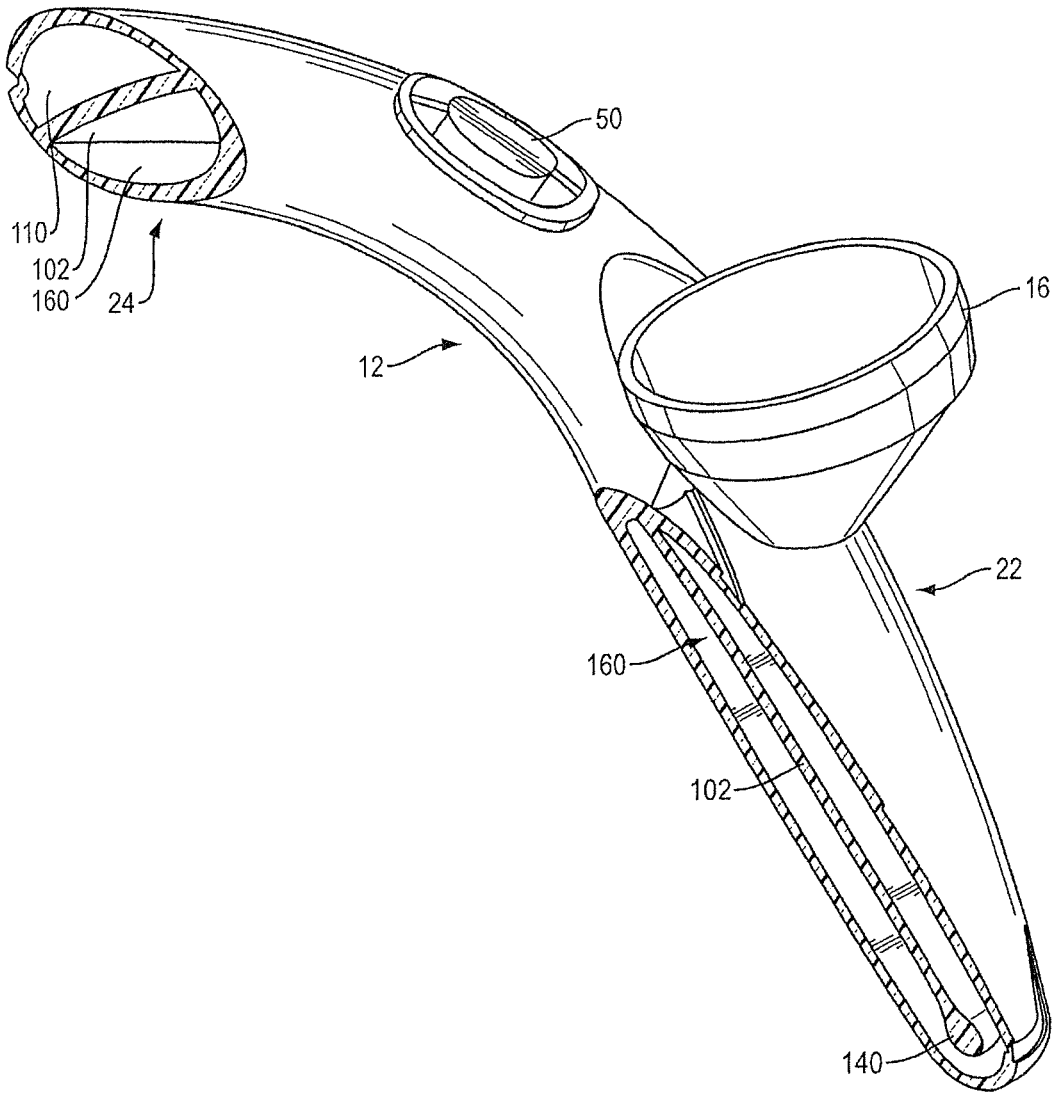
FIG. 8 is a second cross-sectional view of the acoustic device taken along line 8-8 in FIG. 1.
Figure 9:
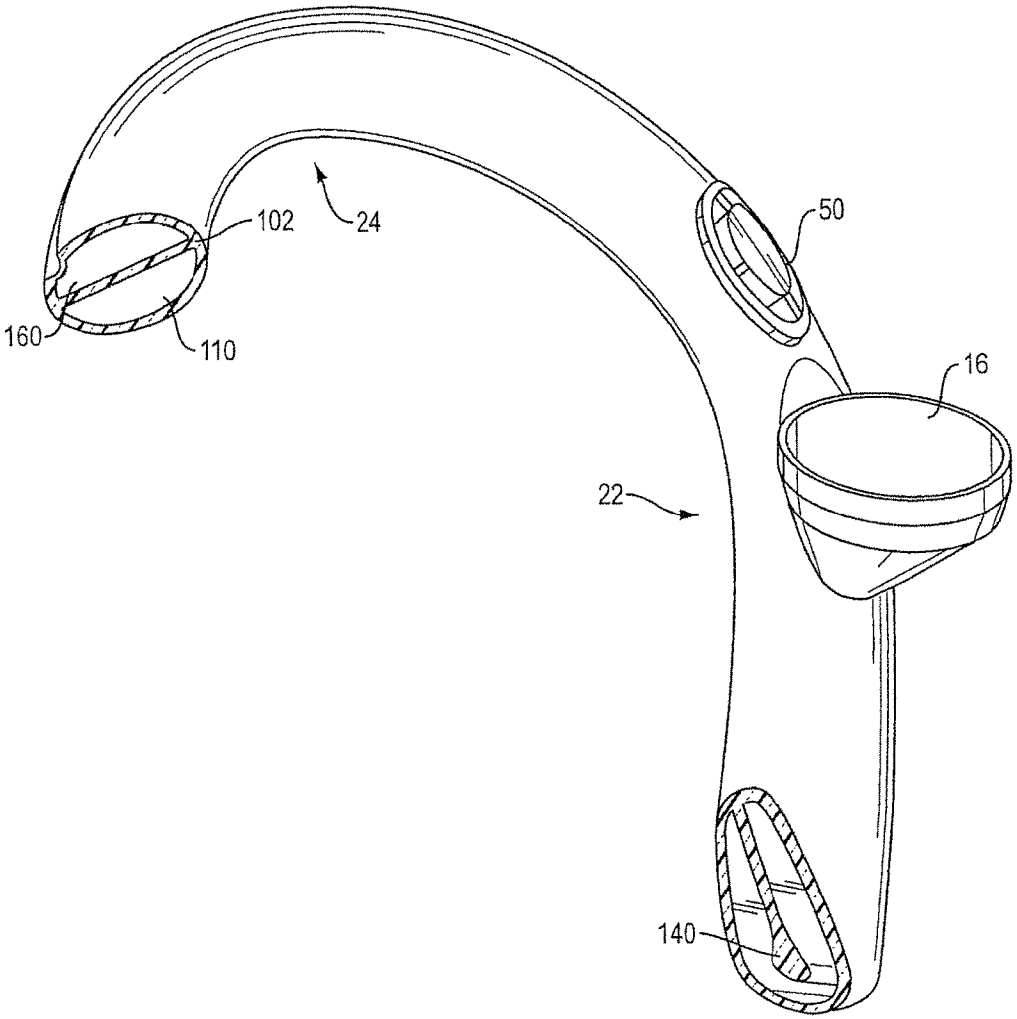
FIG. 9 is a third cross-sectional view of the acoustic device taken along line 9-9 in FIG. 1.

The first part of waveguide 110 is shown in FIG. 7. Waveguide entrance 114 is located directly behind the rear **14*a* of acoustic driver 14, which has a front side 14*b* that is pointed toward the expected location of the right ear. Downward leg 116 of waveguide 110 is located above septum 102 and below upper wall/top 30 of the housing. Turn 120 is defined between end 118 of septum 102 and closed rounded end 27 of housing 12. Waveguide 110 then continues below septum 102 in upward portion 122 of waveguide 110. Waveguide 110 then runs under diverter 133 that is part of septum 102 (see waveguide portion 124), where it turns to run into central housing portion 24. FIGS. 8 and 9 illustrate how the two identical waveguides 110 and 160 run along the central portion of the housing and within it fold or flip over each other so that each waveguide begins and ends in the top portion of the housing. This allows each waveguide to be coupled to the rear of one driver in one leg of the neck loop and have its outlet in the top of the housing in the other leg, near the other driver. FIGS. 8 and 9** also show second end 140 of septum 102, and the arrangement of waveguide 160 which begins behind driver 16, runs down the top of leg 22 where it turns to the bottom of leg 22 and runs up leg 22 into central portion 24. Waveguides 110 and 140 are essentially mirror images of each other.

In one non-limiting example, each waveguide has a generally consistent cross-sectional area along its entire length, including the generally annular outlet opening, of about 2 $cm^2$. In one non-limiting example each waveguide has an overall length in the range of about 22-44 cm; very close to 43 cm in one specific example. In one non-limiting example, the waveguides are sufficiently long to establish resonance at about 150 Hz. More generally, the main dimensions of the acoustic device (e.g., waveguide length and cross-sectional area) are dictated primarily by human ergonomics, while proper acoustic response and functionality is ensured by proper audio signal processing. Other waveguide arrangements, shapes, sizes, and lengths are contemplated within the scope of the present disclosure.

Figure 10:
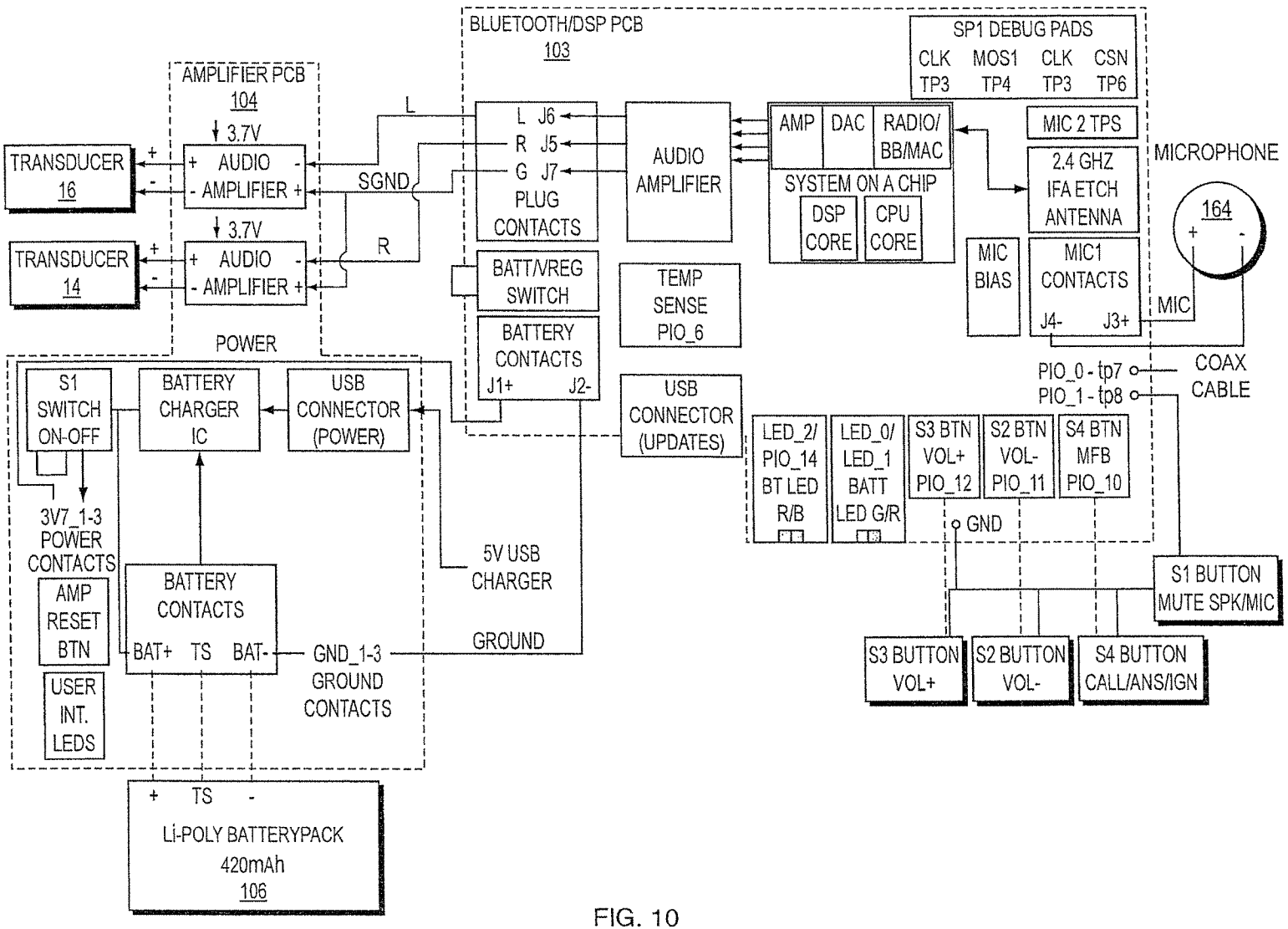
FIG. 10 is a schematic block diagram of the electronics for an acoustic device.

An exemplary but non-limiting example of the electronics for the acoustic device are shown in FIG. 10. In this example the device functions as a wireless headset that can be wirelessly coupled to a smartphone, or a different audio source. PCB 103 carries microphone 164 and mic processing. An antenna receives audio signals (e.g., music) from another device. Bluetooth wireless communication protocol (and/or other wireless protocols) are supported. The user interface can be but need not be carried as portions of both PCB 103 and PCB 104. A system-on-a-chip generates audio signals that are amplified and provided to L and R audio amplifiers on PCB 104. The amplified signals are sent to the left and right transducers (drivers) 16 and 14, which as described above are open-backed acoustic drivers. The acoustic drivers may have a diameter of 40 mm diameter, and a depth of 10 mm, but need not have these dimensions. PCB 104 also carries battery charging circuitry that interfaces with rechargeable battery 106, which supplies all the power for the acoustic device.

Figure 11:
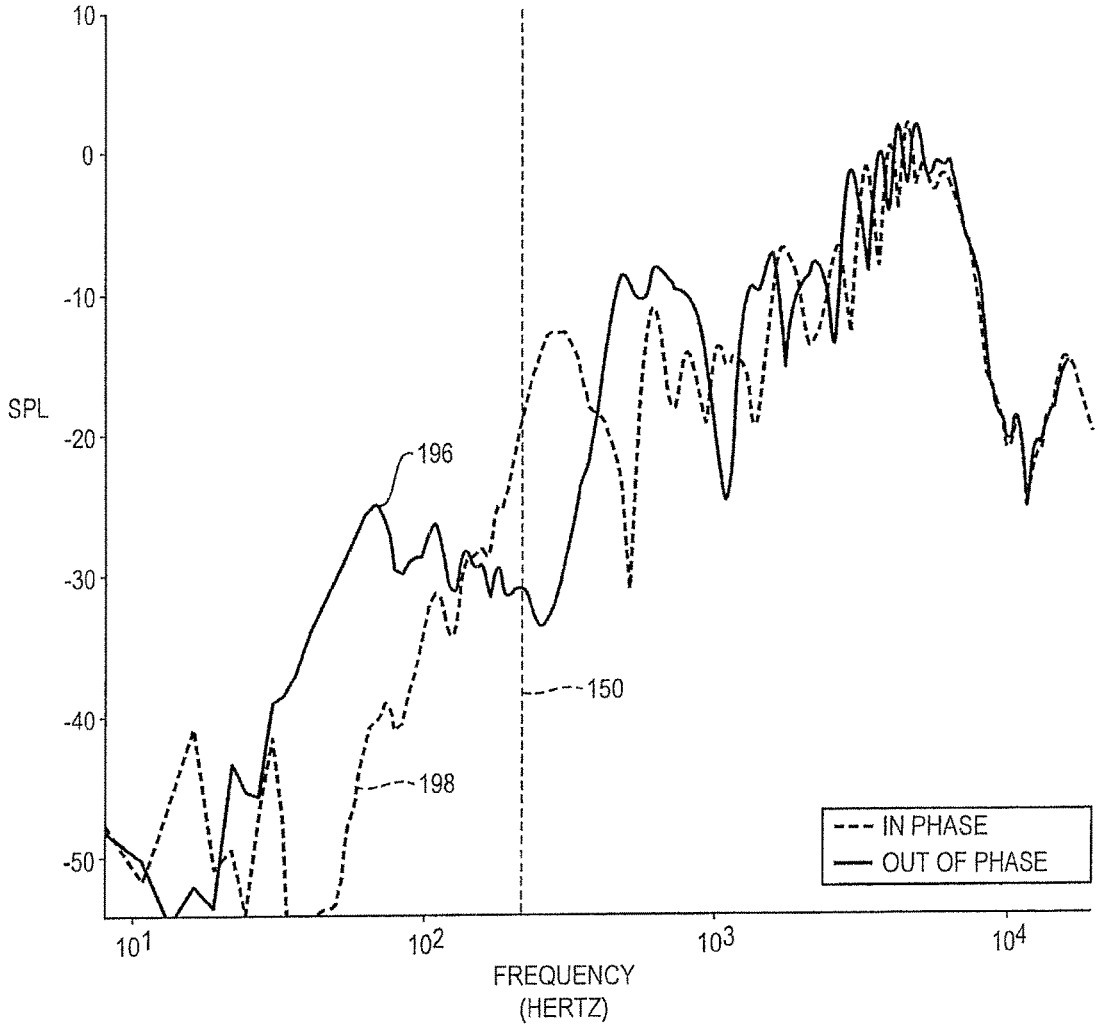
FIG. 11 is a plot of the sound pressure level at an ear of a dummy head, with the drivers of the acoustic device driven both in phase and out of phase.

FIG. 11 illustrates the SPL at one ear with the acoustic device described above. Plot 196 is with the drivers driven out of phase and plot 198 is with the drivers driven in-phase. Below about 150 Hz the out of phase SPL is higher than for in-phase driving. The benefit of out of phase driving is up to 15 dB at the lowest frequencies of 60-70 Hz. The same effect takes place in the frequency range from about 400 to about 950 Hz. In the frequency range 150-400 Hz in-phase SPL is higher than out of phase SPL; in order to obtain the best driver performance in this frequency range the phase difference between left and right channels should be flipped back to zero. In one non-limiting example the phase differences between channels are accomplished using so-called all pass filters having limited phase change slopes. These provide for gradual phase changes rather than abrupt phase changes that may have a detrimental effect on sound reproduction. This allows for the benefits of proper phase selection while assuring power efficiency of the acoustic device. Above 1 KHz, the phase differences between the left and right channels has much less influence on SPL due to the lack of correlation between channels at higher frequencies.

The waveguides of the subject acoustic device are resonant structures. It can be beneficial to suppress one or more undesirable resonances while preserving the resonances that reinforce the acoustic performance of the acoustic device. Resonance peaks can be reduced by introducing into the waveguide a source of resistive loss. Resistive loss elements can reduce undesirable peaks and dips in the device output, making the device output more predictable and more power efficient.

Loss elements can cause one or both of velocity loss and pressure loss. Examples of velocity loss elements include but are not limited to materials that provide resistance to air flow, including foam with open cells, fiberglass, wool, or any other open fluff, and resistive woven screens made out of fabric, plastic, metal, or other materials. Velocity loss elements will reduce the waveguide's output acoustic energy level across different frequencies to different degree. This can be counteracted by increasing the acoustic pressure within the waveguide, but this is not always feasible. Velocity loss elements alone may thus not achieve optimum broadband waveguide performance.

Pressure loss elements are impedance elements located at areas of the waveguide with high pressure, e.g., at pressure maxima for the resonances to be damped. Pressure loss elements create a shunting velocity that will help to reduce undesirable high pressure modes. Non-limiting examples of pressure loss elements include closed cell foam located against the inner wall of the waveguide, or in the waveguide away from the wall, and a wall opening lined with any resistive screen, mesh or fluff similar to the velocity loss elements.

In order to design a practical acoustic device with suppression of undesirable resonances, the loss elements should be introduced so that they suppress undesirable modes while minimizing the effect on desirable modes. This can be achieved by introducing loss elements into specially selected waveguide locations and/or by using loss elements that are themselves resonant structures that have the desired resonant frequencies and are placed at a location where they are active at those frequencies. Some loss elements can achieve only one of these goals while others can achieve both, as is further described below.

Figure 12A:
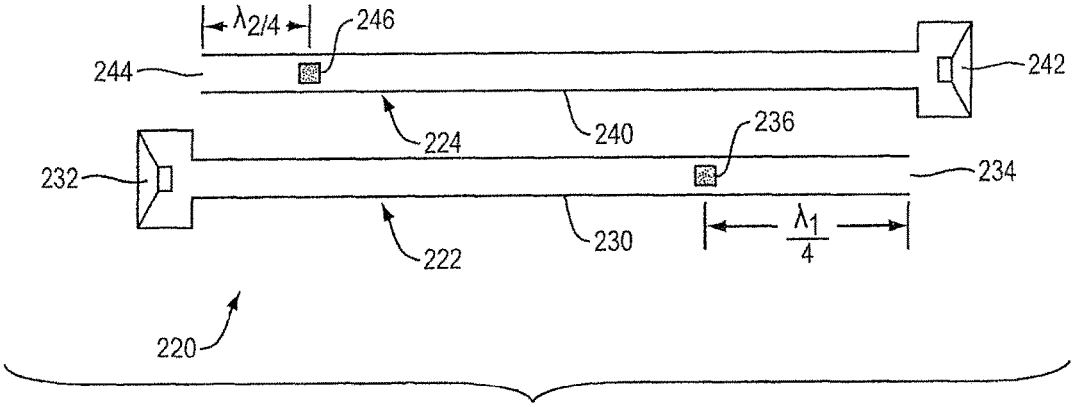
FIG. 12A is a highly schematic diagram of an acoustic device with loss elements that suppress undesirable resonances.
Figure 12B:
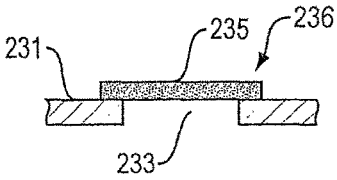
FIG. 12B is an enlarged partial schematic view of a loss element.

FIG. 12A schematically illustrates acoustic device 220 that includes acoustic waveguides 222 and 224. Transducer 232 is located at one open end of tube 230 of waveguide 222. Pressure loss element 236 is located at approximately one quarter of the wavelength ($lambda_1/4$) distance (at the frequency to be damped) from the other end 234 of tube 230. Transducer 242 is located at one open end of tube 240 of waveguide 224. Pressure loss element 246 is located at one quarter of the wavelength ($lambda_2/4$) distance (at the frequency to be damped) from the other end 244 of tube 240. FIG. 12B is a partial enlarged view of an example of pressure loss element 236, which is accomplished with opening 233 in wall 231 of tube 230, backed by resistive element (e.g., foam, fluff, a screen, and/or mesh) 235. Resistive element 235 could alternatively be located in opening 233 or on the inside of wall 231 covering opening 233. In additional alternative configurations, pressure loss elements 236 or 246 could comprise a material that lines an interior surface of the waveguide in whole or in part.

Figure 13:
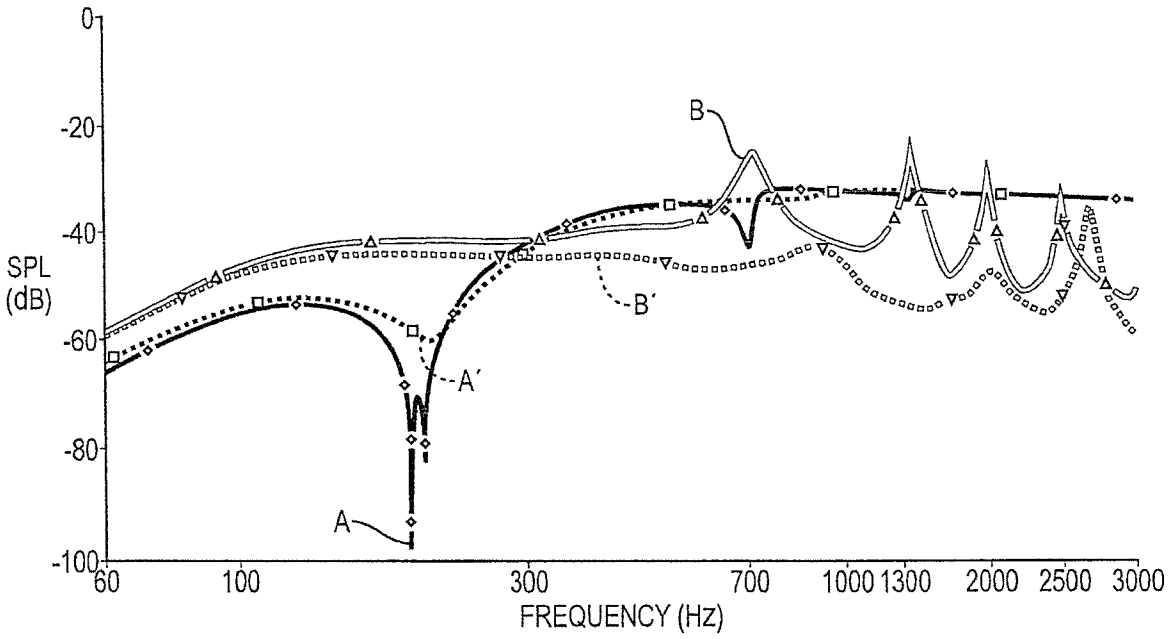
FIG. 13 illustrates sound pressure level vs. frequency for an example of a waveguide of an acoustic device.

FIG. 13 illustrates output sound pressure level (SPL) (in dB) vs. frequency for an example of waveguide 222. Radiation from the front of transducer 232 is depicted by curve A, and radiation from waveguide open end 234 is depicted by curve B. Curves A and B illustrate the outputs without a pressure loss element, while curves A' and B' illustrate the outputs with a pressure loss element 236, FIG. 12A, respectively.

The waveguide output (curve B) has multiple resonances at the frequencies 700 Hz and above. In order to damp the 1300 Hz resonance (the highest peak), a pressure loss element 236 needs to be located at about 6.5 cm from the waveguide open end 234 (6.5 cm corresponds to about ¼ of the 1300 Hz wavelength in air of about 27 cm). The resistance (impedance) value of the loss element 236 is selected (via the material of the pressure loss element and/or the size of any opening contained in pressure loss element) to have the maximum suppression of the 1300 Hz mode with acceptable loss at other frequencies. A desirable resistance value is one that reduces the pressure peak while having minimal effect on other waveguide modes. The value of the resistance depends at least in part on waveguide geometry and audio system design requirements, and can be determined either experimentally or by audio system simulation.

In the example illustrated in FIG. 13 the 1300 Hz mode is suppressed by more than 25 dB, with only about 1 dB loss at 100 Hz. This result is a direct consequence of the selective spatial location of the loss resistance. Another benefit of the pressure loss element is that all standing waves that create pressure peaks at the location of pressure loss element 236 are also suppressed. In this example suppression is seen at 700 Hz and 2 KHz. To suppress the other resonance frequencies (like the one at about 2.5 KHz) one or more additional pressure loss elements may be installed at a location of a pressure maximum for each frequency. A similar result (not illustrated in FIG. 13) is created in waveguide 224. In one non-limiting example, three or four pressure loss elements may be used.

Note that pressure loss elements will have an effect if they are installed at locations of high pressure but not necessarily at maximum pressure locations. Also, the elements can be installed at pressure maxima closer to the transducer than shown in FIG. 12A, but the effect is greatest if they are closest to the open end of the waveguide.

Figure 14:
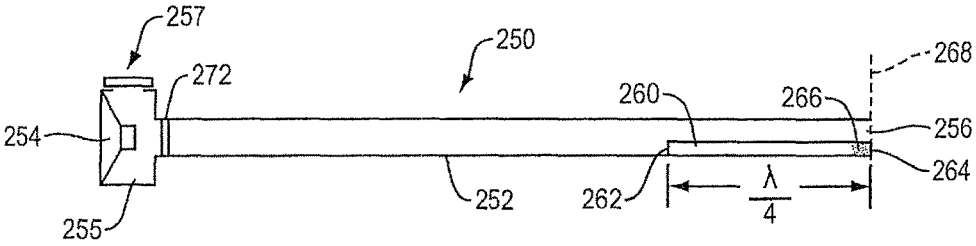
FIG. 14 schematically illustrates an alternative type of loss element in a waveguide of an acoustic device.

FIG. 14 schematically illustrates an example of a pressure loss element that has both spatial and frequency properties. Pressure loss stub 260 is an open-ended tube located inside tube 252 of waveguide 250 (which has transducer 254 at one end and is open at the other end 256). Stub 260 acts as a small cross section shunt waveguide. Stub 260 is preferably but not necessarily located near main waveguide open end 256.

Stub 260 is constructed, arranged and located to produce low z-impedance at the resonant frequency being suppressed. Its opening 262 is placed approximately at the location of a pressure maximum of the resonant frequency. Stub 260 is preferably vented into (i.e., acoustically coupled to) main waveguide 252, but it can be either inside or outside of waveguide 252. The other end 264 of stub 260 is resistively (velocity) loaded (e.g., with resistive element 266, which in non-limiting examples could be foam, wire mesh, fabric mesh, a screen and/or fluff). The value of the resistive loading of stub 260 is selected such that the bandwidth of the impedance minimum of stub 260 is approximately equal to or slightly larger than the bandwidth of the waveguide peak.

As depicted in FIG. 14, if stub 260 is aligned parallel to main waveguide 252 both waveguides may have their open ends in the same plane 268. In this case the length of stub 260 will be equal to approximately ¼ of the sound wavelength (lambda/4) at the frequency to be suppressed. The area of stub 260 is typically much smaller than that of main waveguide 252, typically around 5-10% or less for practical purposes. Stub 260 can be constructed of a suitable plastic material, which can be the same material that main waveguide 252 is made from, or any other suitable material.

FIG. 14 also illustrates optional pressure loss element 257 in volume 255 behind transducer 254. Volume 255 is acoustically coupled to main waveguide 252. In this non-limiting example element 257 is similar to pressure loss element 236, FIG. 12B, and can comprise an opening in the wall of volume 255, backed by a resistive element. Pressure loss element 257 can alternatively be accomplished in manners described elsewhere herein, such as with closed-cell foam located against the inner wall of the volume 255, or in volume 255 away from the inner wall. Pressure loss element 257 will reduce the acoustic pressure that drives waveguide 252 and so will have an effect on all modes. Pressure loss element 257 can be effective to reduce resonance peaks by a first amount (e.g., around 3 dB) and reduce lower frequencies by a lesser amount (e.g., around 1 dB). Element 257 can, for example, be used when there is difficulty placing a loss element in or on the main waveguide.

Figure 15:
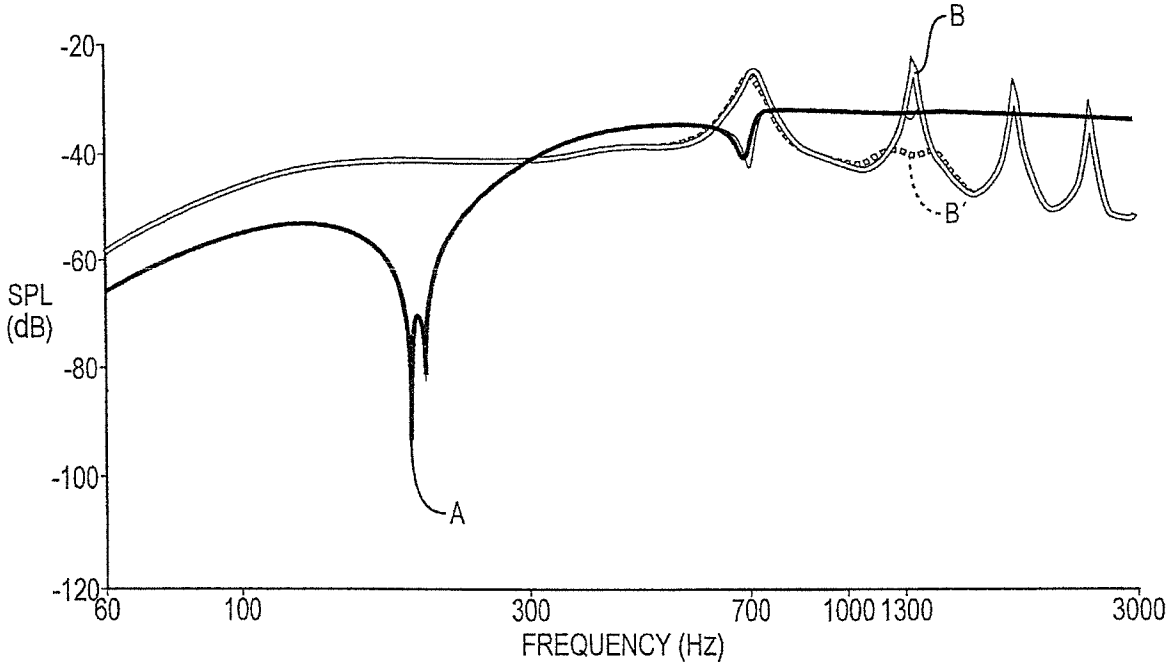
FIG. 15 illustrates sound pressure level vs. frequency for another example of a waveguide of an acoustic device.

FIG. 15 illustrates output SPL (dB) vs. frequency for an example of waveguide 250, FIG. 14. Radiation from the front of transducer 254 is depicted by curve A, and radiation from waveguide open end 256 is depicted by curve B. Curves A and B illustrate the output without a pressure loss stub/shunt waveguide 260. Curve B' illustrates the output from open end 256 with pressure loss stub/shunt waveguide 260.

In this example the stub was positioned with its opening in the main waveguide approximately 6.5 cm from the main waveguide open end, and has a length of about 6.5 cm (which is about ¼ of the sound wavelength at 1300 Hz). The undesirable peak at about 1300 Hz is suppressed by about 15 dB, while most of the other resonances are left substantially undisturbed. Accordingly, a pressure loss element that has both spatial and frequency properties, such as that shown in FIG. 14, may be used when a single undesirable resonance mode needs to be suppressed.

Acoustic devices can include one or more of such pressure loss or dual loss elements (i.e., pressure loss elements that have both spatial and frequency properties) in one or both of the waveguides in order to improve acoustic performance.

One potential issue with the present acoustic device is that it has two openings in the housing, one at the end of each waveguide. Sand, dirt and other particles can enter through these openings. These particles can interfere with operation of the acoustic device. For example the particles can jam into the small clearance between the voice coil and the magnet, which can be as small as about 0.3 mm. Proper operation of the transducer can thus be compromised by foreign particles. Particles can be inhibited from reaching the transducer by the use of a low resistance screen (which acts as a velocity loss element) somewhere between the back of the transducer and the waveguide opening. In order to inhibit SPL losses from such a velocity loss element, this screen should be located at a velocity minimum, or at least where volume velocity is low. One possible location is directly behind the transducer, where velocity is low, as depicted by screen 272, FIG. 14. The screen should ideally have openings that are smaller than the clearance between the voice coil and the magnet of the transducer that is being protected.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device, comprising:

a neck loop that is constructed and arranged to be worn around at least a portion of a user's neck, the neck loop comprising a central portion, first and second depending portions that extend from the central portion, a first acoustic waveguide, and a second acoustic waveguide;

a first acoustic driver in the first depending portion, wherein the first acoustic driver is constructed and arranged to radiate sound outwardly from both the first and second depending portions;

a second acoustic driver in the second depending portion, wherein the second acoustic driver is constructed and arranged to radiate sound outwardly from both the first and second depending portions;

wherein the first acoustic waveguide carries sound from the first acoustic driver, and the second acoustic waveguide caries sound from the second acoustic driver;

a first pressure damping element acoustically coupled to the first waveguide, where the first pressure damping element is constructed and arranged to damp one or more acoustic resonances in the first waveguide; and a second pressure damping element acoustically coupled to the second waveguide, where the second pressure damping element is constructed and arranged to damp one or more acoustic resonances in the second waveguide.

2. The acoustic device of claim 1, wherein over at least some of a frequency range of the acoustic drivers, the acoustic drivers are driven such that they radiate sound that is out of phase.

3. The acoustic device of claim 1, wherein each acoustic waveguide carries sound from only one acoustic driver.

4. The acoustic device of claim 3, wherein the first and second acoustic drivers each radiate sound from a front side and a back side, and where the same of either the front side or the back side of both transducers are acoustically coupled to the respective waveguides.

5. The acoustic device of claim 4, wherein the other of either the front side or the back side of both transducers are arranged to radiate sound directly outwardly from the neck loop.

6. The acoustic device of claim 5, further comprising a first sound outlet opening of the first waveguide and second sound outlet opening of the second waveguide, wherein the first sound outlet opening is in the second depending portion and the second sound outlet opening is in the first depending portion.

7. The acoustic device of claim 6, wherein the first sound outlet opening is located proximate to the second acoustic driver and the second sound outlet opening is located proximate to the first acoustic driver.

8. The acoustic device of claim 1, wherein each acoustic waveguide extends through the central portion of the neck loop.

9. The acoustic device of claim 8, wherein each acoustic waveguide further extends through at least some of both depending portions of the neck loop.

10. The acoustic device of claim 1, further comprising a housing that carries both waveguides, wherein the first acoustic driver is recessed within the housing, and the second acoustic driver is recessed within the housing.

11. The acoustic device of claim 1, further comprising a first sound outlet opening of the first waveguide and second sound outlet opening of the second waveguide, wherein the first sound outlet opening is located proximate to the second acoustic driver and the second sound outlet opening is located proximate to the first acoustic driver.

12. The acoustic device of claim 11, wherein each waveguide has one end with its corresponding acoustic driver located at one side of the head and in proximity to and below the adjacent ear, and another end that leads to its sound outlet opening, located at the other side of the head and in proximity to and below the other, adjacent ear.

13. The acoustic device of claim 1, wherein the first and second pressure damping elements comprise at least one of: foam with at least some closed cells; a waveguide wall opening with a resistive structure covering or in the wall opening; and a pressure-loss stub.

14. The acoustic device of claim 1, wherein at least one of the first and second pressure damping elements comprises a shunt waveguide.

15. The acoustic device of claim 1, wherein the first and second acoustic drivers each radiate sound from a front side and a back side, wherein the first acoustic driver radiates sound from one of its front side and back side directly outwardly from the first depending portion of the neck loop, the second acoustic driver radiates sound from one of its front side and back side directly outwardly from the second depending portion of the neck loop, the first acoustic driver radiates sound from the other of its front side and back side outwardly from the second depending portion of the neck loop, and the second acoustic driver radiates sound from the other of its front side and back side outwardly from the first depending portion of the neck loop.

16. The acoustic device of claim 1, wherein over at least some of the frequency range of the acoustic drivers, the acoustic drivers are driven such that they radiate sound that is out of phase, and over at least some of the frequency range of the acoustic drivers, the acoustic drivers are driven such that they radiate sound that is in phase.

17. The acoustic device of claim 1, wherein the first pressure damping element is acoustically coupled to the first waveguide at a first location of a pressure maximum for a first wavelength to be damped, and wherein the second pressure damping element is acoustically coupled to the second waveguide at a second location of a pressure maximum for a second wavelength to be damped.

18. The acoustic device of claim 17, further comprising a first sound outlet opening of the first waveguide and second sound outlet opening of the second waveguide, and wherein the first location is at a distance from the first sound outlet opening of about one-quarter of the first wavelength, and wherein the second location is at a distance from the second sound outlet opening of about one-quarter of the second wavelength.

19. An acoustic device, comprising:

a neck loop that is constructed and arranged to be worn around at least a portion of a user's neck;

a first acoustic driver;

a second acoustic driver;

a first acoustic waveguide that extends through the central portion of the neck loop and at least some of both depending portions of the neck loop and having a first sound outlet opening; and a second acoustic waveguide that extends through the central portion of the neck loop and at least some of both depending portions of the neck loop and having a second sound outlet opening;

a first pressure damping element acoustically coupled to the first waveguide, where the first pressure damping element is constructed and arranged to damp one or more acoustic resonances in the first waveguide; and a second pressure damping element acoustically coupled to the second waveguide, where the second pressure damping element is constructed and arranged to damp one or more acoustic resonances in the second waveguide;

wherein the first acoustic driver is constructed and arranged to radiate sound into the first acoustic waveguide and outwardly from the neck loop via the first sound outlet opening, but the first acoustic driver does not radiate sound into the second acoustic waveguide; and wherein the second acoustic driver is constructed and arranged to radiate sound into the second acoustic waveguide and outwardly from the neck loop via the second sound outlet opening, but the second acoustic driver does not radiate sound into the first acoustic waveguide.

20. The acoustic device of claim 19, wherein the first and second acoustic drivers each radiate sound from a front side and a back side, and wherein one of the front and back sides of the first acoustic driver is acoustically coupled to the first acoustic waveguide and one of the front and back sides of the second acoustic driver is acoustically coupled to the second acoustic waveguide.

21. The acoustic device of claim 20, wherein one of the front and back sides of each of the first and second acoustic drivers is arranged to radiate sound directly outwardly from the neck loop.

22. The acoustic device of claim 19, wherein the first sound outlet opening is located proximate to the second acoustic driver and the second sound outlet opening is located proximate to the first acoustic driver.

23. The acoustic device of claim 22, wherein each waveguide has one end with its corresponding acoustic driver located at one side of the head and in proximity to and below the adjacent ear, and another end that leads to its sound outlet opening, located at the other side of the head and in proximity to and below the other, adjacent ear.

24. The acoustic device of claim 19, wherein the first and second acoustic drivers each radiate sound from a front side and a back side, and wherein the first acoustic driver radiates sound from one of its front side and back side directly outwardly from the first depending portion of the neck loop and the second acoustic driver radiates sound from one of its front side and back side directly outwardly from the second depending portion of the neck loop.

25. The acoustic device of claim 24, wherein the first acoustic driver radiates sound from one of its front side and back side outwardly from the second depending portion of the neck loop and the second acoustic driver radiates sound from one of its front side and back side outwardly from the first depending portion of the neck loop.

26. The acoustic device of claim 19, wherein the first and second pressure damping elements comprise at least one of: foam with at least some closed cells; a waveguide wall opening with a resistive structure covering or in the wall opening; and a pressure-loss stub.

27. The acoustic device of claim 19, wherein at least one of the first and second pressure damping elements comprises a shunt waveguide.

* * * * *